United States Patent [19]

Hodgson et al.

[11] 4,451,104

[45] May 29, 1984

[54] APPARATUS FOR SPLICING ELECTRIC WIRES

[75] Inventors: Sten E. Hodgson, Scotch Plains; Richard J. Gemra, Union Township, Union County, both of N.J.

[73] Assignee: AT&T Technologies, Inc., New York, N.Y.

[21] Appl. No.: 382,748

[22] Filed: May 27, 1982

[51] Int. Cl.[3] ..... H01R 9/08

[52] U.S. Cl. ..... 339/99 R; 339/97 R; 339/98

[58] Field of Search ..... 339/97 R, 95 R, 98, 339/95, 96, 273 F

[56] References Cited

U.S. PATENT DOCUMENTS

| | | | |
|---|---|---|---|
| 2,359,541 | 10/1944 | Bancroft | 339/97 R |
| 3,041,575 | 6/1962 | Schneider | 339/99 R |
| 3,115,541 | 12/1963 | Hanner et al. | 174/92 |
| 3,189,863 | 6/1965 | Leach | 339/99 R |
| 3,201,745 | 8/1965 | Williams | 339/99 R |
| 3,533,049 | 10/1970 | Thompson | 339/99 |
| 3,553,631 | 1/1971 | Schlesinger, Jr. | 339/97 |
| 3,573,713 | 4/1971 | Enright et al. | 339/98 |
| 3,579,172 | 5/1971 | Clark | 339/97 |
| 3,766,514 | 10/1973 | Kimm | 339/95 R |
| 4,157,208 | 6/1979 | Roberts et al. | 339/98 |

*Primary Examiner*—William R. Briggs
*Attorney, Agent, or Firm*—R. F. Kip, Jr.

[57] ABSTRACT

Apparatus for effecting a drop wire splice comprises an enclosure having a pair of channels with each channel extending from an entrance end to an exit end. A partition is located between the channels and a ramped surface is located on a wall of each channel opposite the partition with the ramped surface widening each channel as it extends from its entrance to exit end. Embedded in the partition are a pair of electrically conductive terminals each of which comprises tangs extending into each channel at an angle inclined toward the exit end. The apparatus further comprises a pair of wedges for insertion into the exit end of each channel. After a drop wire is fully inserted into each channel through the entrance end with the wire overlapping the tangs of the terminals, a wedge is forced into the exit end of each channel between the ramped surface and the wire to force the drop wire down onto the tangs of the terminal thereby making an electrical contact with the tangs and locking the drop wire in each channel between the partition and the forcibly inserted wedge.

7 Claims, 5 Drawing Figures

APPARATUS FOR SPLICING ELECTRIC WIRES

TECHNICAL FIELD

This invention relates to apparatus for connecting electric wires and in particular to wire splicing apparatus for splicing telephone drop wires in the field.

BACKGROUND OF THE INVENTION

The telephone wires which extend from the nearest telephone pole to a subscriber's house are called drop wires, and it is often required to connect or splice the electrical conductors of one drop wire with the electrical conductors of another drop wire. The splice must make good electrical contact while at the same time be sufficiently strong to withstand up to 400 pounds in tension pullout since the spliced drop wire must bear the weight of the entire length of the suspended wire in all types of weather.

One present method of effecting a drop wire splice is to cut back the insulation at the ends of the wires to be connected, insert the wires into brass sleeves and crimp the sleeves about the inserted wires to establish a strong electrical connection between the crimped wires. The crimped splice is then enclosed by vinyl tape wrappings. This method is time consuming, requires a special crimping tool and the resulting splice exhibits a low life cycle.

There also exist numerous commercially available splicing devices such as the AMP Drop Wire splice sold by Amp, Inc. of Harrisburg, Pa. Although these splicing apparatus effect a more reliable splice than the sleeve splicing method described above, most of the devices require screws or clamps, are relatively expensive to use in both material and labor costs and often require a special tool for installation.

Another electric wire connecting device of the type described above is disclosed in U.S. Pat. No. 3,766,514 dated Oct. 16, 1973 to Herbert J. Kimm. Kimm's device comprises a housing having a chamber with openings at either end to accept electric wires. A pair of wedge shaped members are positioned in the chamber resting on ramped shaped surfaces such that as electric wires, which have been previously inserted into the openings, are partially removed from the housing the wires engage the wedge shaped members which press the wires into contact with a terminal also positioned in the housing. The terminal gouges into the insulating jacket surrounding the wire, as the wire is partially pulled from the housing, to make electrical contact with the wire.

Kimm requires, as described above, the partial removal of an already fully inserted wire for the device to operate. It is the outward movement of the wire which engages the wedges to press the wire against the terminal to make an electrical contact. Thus, if the wire were pushed back into the housing, the force exerted on the wedge shaped member by the wire would now be directed in a direction opposite to that required to operate the device so as to loosen the terminal connection. A splice using the Kimm device on a drop wire located between a subscriber's premises and a telephone pole would be subjected to the drop wire being pushed and pulled because of the environment, such as wind, ice, snow, and this constant pushing and pulling could cause the inserted wire and engaged wedge to become dislodged thereby removing the force required to effect a proper electrical connection between the partially inserted wire and terminal.

There is a need, therefore, for splice apparatus to connect electric wires, which apparatus can be easily used without the aid of special tools and which use will result in a reliable splice.

SUMMARY OF THE INVENTION

The foregoing problems are solved by the present invention in which apparatus for connecting electric wires comprises a housing having a pair of channels with each channel extending through the housing from an entrance opening to an exit opening. The housing further comprises a partition located between the channels; a ramped surface on a wall in each channel opposite the partition with the ramped surface widening each channel as it extends from the entrance opening to the exit opening and an electrically conductive terminal embedded in the partition having tangs extending into each channel at an angle inclined toward the exit opening of each channel. The apparatus also comprises a pair of wedges for insertion into the exit end of each channel. After an electric wire is inserted into each channel through the entrance end a sufficient distance into the channel until the wire at least overlays the tangs of the terminal, a wedge is forced into the exit end of each channel to force the inserted electric wire down onto the tangs of the terminal to make electrical contact with the terminal and to force the electric wire into locked engagement between the partition and the inserted wedge in each channel.

In one embodiment of the invention, the partition has a non-smooth surface on each wall facing the channels and the wedge has a non-smooth surface on the side facing the partition to further lock the electric wire between the non-smooth surfaces of the partition and the inserted wedge.

In another embodiment of the invention, a quantity of moisture resistant encapsulant is located within each channel to provide moisture resistance to the areas around where the terminals come into electrical contact with the electric wires.

BRIEF DESCRIPTION OF THE DRAWINGS

Other features and advantages of the invention, its organization, construction, and operation will be best understood from the following detailed description of a specific embodiment thereof, taken in conjunction with the accompanying drawings in which.

DETAILED DESCRIPTION OF THE DRAWINGS

Figure 1:
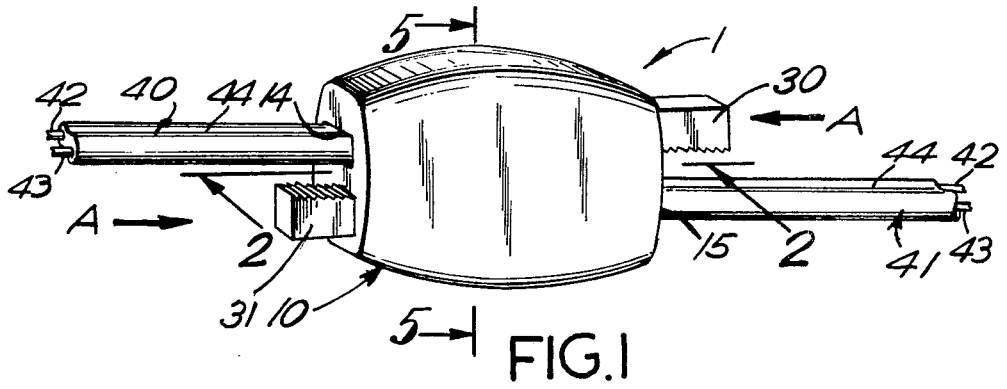
FIG. 1 is a perspective view of a fully assembled splice apparatus showing the housing and electrical wires and wedges inserted into the housing.
Figure 2:
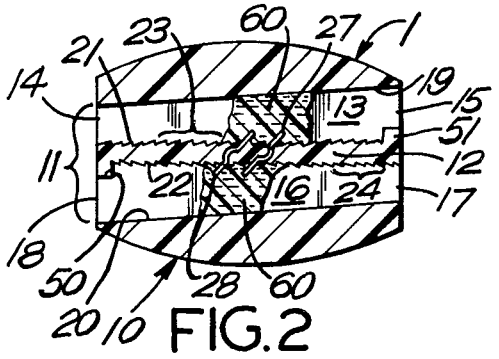
FIG. 2 is a cutaway section of the housing taken along lines 2—2 of FIG. 1 but without the drop wires and wedges inserted into the housing.
Figure 3:
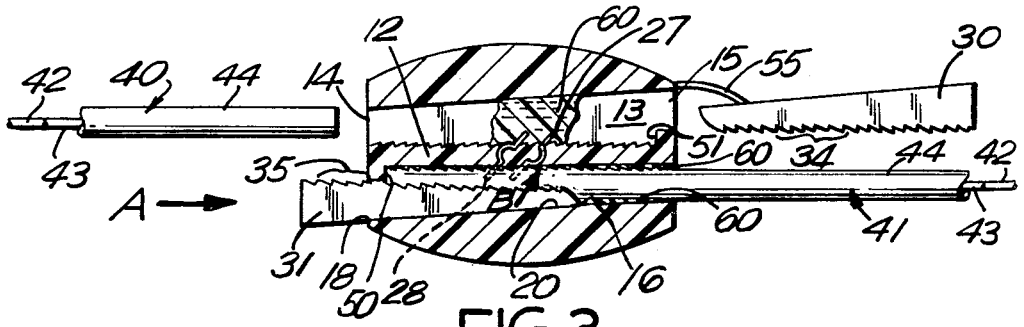
FIG. 3 is a cutaway section of the housing similar to that seen in FIG. 2 but illustrating the insertion of a wire and wedge into the housing.

Referring to FIG. 1, there is seen a splice apparatus 1, comprising a housing or "shell" 10 constructed of electrically non-conductive material. Housing 10 has a longitudinal passage 11, as best seen in FIGS. 2 and 3, divided by partition 12 into an upper channel 13 with an entrance end 14 and an exit end 15, and a lower channel 16 with an entrance end 17 and an exit end 18. The walls 19 and 20 of, respectively, channels 13 and 16, which walls are away from partition 12, are inclined so as to laterally widen each such channel with displacement away from its entrance end. The sides 21 and 22 of partition 12 which bound, respectively, the channels 13 and 16 have a non-smooth surface comprising a longitudinal distribution thereon of transverse teeth 23 and 24, respectively, whose axes are inclined to the vertical so as to not impede forward motion in the channel of an object introduced through its entrance end, but, on the other hand, to bite into such object if it is attempted to withdraw such object from the channel through such entrance end. The shell 10, when in use, is formed together to close passage 11 therein as seen in FIG. 1.

Figure 4:
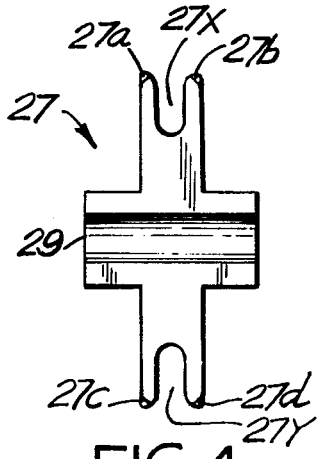
FIG. 4 is a view of a terminal.

Partition 12 has a pair of electrically conductive contacts 27,28, made of beryllium copper, embedded near its longitudinal midpoint as seen in FIGS. 2 and 3. FIG. 4 shows contact 27, which is similar in construction to contact 28, comprising a central conductive portion 29 and two pairs of bifurcated conductive tangs **27*a*, 27*b* and 27*c*, 27*d* projecting in opposite directions outward from the central portion 29. Central portion 29 of contact 27 is embedded in partition 12. Each pair of bifurcated tangs define a slot 27*x*, 27*y* located between the tangs and slightly smaller in width than the diameter of an electric conductor located in a drop wire which is to be inserted into the channel in which the tangs are positioned. As shown in FIG. 2, the two embedded contacts, 27,28 are longitudinally spaced along partition 12, and are also offset from each other in the transverse direction so as to prevent the terminals 27,28 from accidentally touching during formation of the housing. The contacts 27,28 are so embedded in partition 12 that the contact's bifurcated tangs 27*a*, 27*b* and 28*a*, 28*b* project into the channel 13 at an inclination away from its entrance end 14, and the two contact's bifurcated tangs 27*c*, 27*d* and 28*c*, 28*d* are similarly oriented in channel 16 with respect to its entrance end 17 as best seen in FIGS. 2 and 3**. The bifurcated tangs are, thus, arranged to make electrical and physical contact with an electrical conductor of a drop wire when the drop wire is forced down into the slot between the tangs. As the wire is forced into the slot, the tangs cut through the drop wire insulation surrounding the electrical conductor and come into physical and electrical contact with the conductor as it enters the slot and is pierced by tangs surrounding the slot.

Apparatus 1 also includes two wedges 30 and 31 (FIGS. 1 and 3) adapted to be inserted into, respectively, channels 13 and 16 through the exits ends 15 and 18 thereof. Wedges 30 and 31 have formed on the sides which face toward partition 12 a non-smooth surface comprising longitudinal distributions of transverse teeth 34 and 35 respectively, whose axes are inclined to permit insertion without impediment of those wedges into their respective channels through their exit end, but if it is then attempted to withdraw the wedges, to bite into objects inserted into the channels and adjoining the non-smooth surface thereby preventing withdrawal of the wedges.

Figure 5:
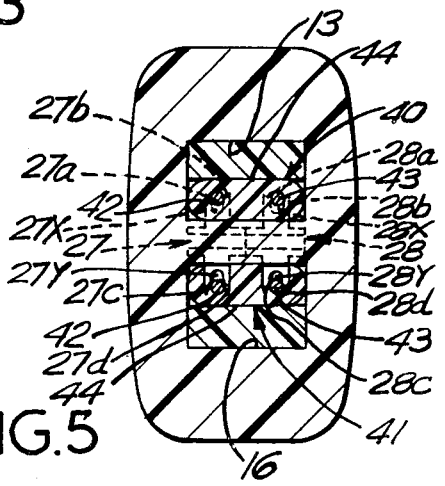
FIG. 5 is a cutaway view of the housing taken along lines 5—5 of FIG. 1.

Splice apparatus 1 is used as follows to interconnect or splice together, the electrical conductors of drop wires 40,41 seen in FIG. 1. First, there is inserted through the entrance end 17 of channel 16 drop wire 41 comprising two conductors 42,43 and an insulating jacket 44 surrounding the conductors. As seen in FIG. 3, drop wire 41 is inserted into channel 16 until its front end comes into contact with lip 50 extending from surface 22 of partition 12 at exit end 18 of channel 16. Drop wire 41, now fully inserted into channel 16, is disposed by the walls of channel 16 to be riding on and laying opposite the bifurcated tangs 27 and 28 projecting into that channel such that the wire conductors 42,43 of drop wire 41 are positioned directly opposite the slots **27*y*, 28*y* located between each set of bifurcated tangs 27,28 as best seen in FIG. 5**.

Next, wedge 31 is inserted, as seen in FIG. 3, through the exit end 18 of the channel 16 in the direction of arrow A, so as to contact inclined wall 20 of channel 16 and to lie between that wall and the section of drop wire 41 previously inserted into that same channel with non-smooth surface 35 in contact with drop wire 41.

Wedge 31 is now forcibly driven by hand into its channel 16 to thereby laterally force contacted drop wire 41, in the direction of arrow B against the bifurcated tangs of channels 27,28 projecting into the channel. The force imparted by wedge 31 on the drop wire ultimately causes bifurcated tangs **27*c*, 27*d* and 28*c*, 28*d* to penetrate, or pierce, insulating jacket 44 of drop wire 40 and to force electrical conductors 42,43 into slots 27*y*, 28*y* located between the bifurcated tangs to make a secure electrical contact with each set of bifurcated tangs of terminals 27,28 as best seen in FIG. 5**.

In a similar manner, drop wire 40 comprising conductors 42,43 is fully inserted into channel 13 through entrance end 14 until it contacts lip 51 so that it overlays terminals 27,28. Next, wedge 30 is inserted into channel 13 through exit end 15 and forced into channel 13 to cause the tangs of terminals 27,28 to come into physical and electrical contact with conductors 42,43 of inserted drop wire 41. Tangs **27*a*, 27*b* of contact 27 make electrical contact with electrical conductor 42 of drop wire 40 inserted into channel 13 while tangs 27*c*, 27*d* make electrical contact with conductor 42 of drop wire 41 in channel 16, thus, electrically bridging the two conductors 42 of drop wires 40,41 together. Similarly, as seen in FIG. 5, tangs 28*a*, 28*b* make electrical contact with conductor 43 inserted into channel 13 and tangs 28*c*, 28*d* make electrical contact with conductor 43 previously inserted into channel 16, thus, electrically bridging the two conductors 43 of drop wires 40,41** together.

Because teeth 21,22 on partition 12 bite into insulation jacket 44 of each inserted drop wire 40,41 as wedges 30,31 are forced into housing 10, drop wires 40,41 cannot be withdrawn from housing 10 when wedges 30,31 are forced into housing 10. Similarly, because teeth 34,35 of wedges 30,31 are arranged to bite into insulation jacket 44 of each inserted drop wire 40,41, wedges 30,31 when once forced deep enough into channels 14,16 cannot be withdrawn therefrom. Apparatus 1 is so designed that attempting to pull inserted drop wires 40,41 from housing 10 have the effect of driving wedges 30,31 further into housing 10 thereby more securely locking drop wires 40,41 in the housing and effecting a more reliable electrical connection between the inserted drop wires.

Wedges 30,31 can be formed as an integral part of apparatus 1 to allow for easier handling of the splice apparatus by an installer in the field. As seen in FIG. 3, wedge 30, for example, is attached to housing 10 by means of a snap neck 55 which easily breaks as wedge 30 is inserted into channel 13. Thus, the attached wedges 30,31 can not be misplaced and can be formed so as to be properly aligned with the channels into which they will be inserted.

So as to insure that splice apparatus 1 provides a moisture proof connection, a sufficient quantity of moisture resistant encapsulant 60 is located within channels 13 and 16 as seen in FIG. 2. The encapsulant 60, which is gelatinous, flows around drop wires 40,41 and wedges 30,31 as they are inserted into apparatus 1 to seal the areas where terminals 27,28 pierce drop wires 40,41 against moisture contamination. An encapsulant, which can be used for this purpose, is polyisobutylene which can be purchased from the Exxon Corporation under the trade name Vistanex LM-MH.

With splice apparatus 1 fully assembled, as seen in FIG. 1, housing 10, in which drop wires 40,41 and wedges 30,31 are inserted to securely lock drop wires 40,41 within housing 10, a secure, reliable, moisture proof, electrical splice is made between drop wires 40,41. Further, apparatus 1 is easily assembled without requiring special tools by an installer in the field.

It will also be apparent that one skilled in the art may make various modifications and changes to the apparatus disclosed herein without departing from the spirit and scope of this invention.

What is claimed is:

1. Apparatus for splicing electric conductors comprising:

a housing having a passage extending therethrough;

a partition extending through the housing dividing the passage into two through channels;

a ramped-shaped wall positioned in each channel opposite the partition for defining each channel with a wide opening at one end and a narrow opening at the other end;

an electrically conductive terminal embedded in the partition and protruding into each channel at an acute angle toward the one end of each channel; and a pair of wedge shaped members each of which being adapted to be force fitted into the one end of each channel after an electric conductor has been inserted into the other end of each channel to fit between the ramped-shaped wall and the inserted conductor to force the conductor down onto the terminal to make electrical contact with the terminal and to lock the electric conductor between the partition and the force fitted wedge shaped member in each channel to effect a splice between the inserted electric conductors.

2. Apparatus as recited in claim 1 wherein a plurality of electrically conductive terminals are embedded in the partition in a spaced apart relationship and protruding into each channel at an acute angle toward the one end of each channel such that each terminal will come into individual electrical contact with one of a plurality of electric conductors inserted into each channel as the wedge shaped member is forced into the one end of the channel.

3. Apparatus as recited in each of claims 1 or 2 further comprising encapsulant means, located in each of the channels, for surrounding the inserted electric conductors and wedges to provide a moisture resistant splice.

4. Apparatus for making an electrical connection between electric wires comprising:

a housing having a pair of channels, each channel extending through the housing from an entrance opening to an exit opening;

a partition located between the channels having a non-smooth surface on a side facing each channel;

a ramped-shaped wall located in each channel on a side opposite the non-smooth partition side and sloped to widen each channel as the channel extends from the entrance opening to the exit opening;

an electrically conductive terminal embedded in the partition, the terminal having tangs extending into each channel at an acute angle inclined toward the exit opening of each channel; and a wedge adapted for insertion into each channel at the exit end thereof and having a non-smooth surface on the side facing the partition such that after an electric wire has been inserted a sufficient distance into each channel through the entrance end until the wire at least overlays the tangs of the terminal extending into each channel, forcing of the wedge into the exit end of each channel between the ramped-shaped wall and the inserted electric wire causes forcing of the electric wire into physical and electrical contact with the tangs of the terminal and into locked engagement between the non-smooth surface of the partition and the non-smooth surface of the wedge forced in to each channel to establish an electrical connection between the inserted electric wires.

5. Apparatus as recited in claim 4 wherein a pair of electrically conductive terminals are embedded in the partition in a spaced apart relationship such that if a drop wire is inserted into each channel and the wedge is forced into the exit end of each channel, each terminal will make individual electrical contact between a conductor of a drop wire in one of the pair of channels and a conductor in the drop wire in the other channel of the pair.

6. Apparatus as recited in each of claims 4 or 5 wherein the channels have located therein sufficient polyisobutylene encapsulant to form a moisture resistant seal about the inserted wedges and electric wires.

7. A splice connector kit having component parts capable of being assembled in the field for splicing telephone drop wires, each wire having a pair of electrical conductors surrounded by a jacket of insulation, the kit comprising:

(1) a housing having:

(a) a pair of channels extending through the housing and adapted to receive a drop wire at one end of each channel and a wedge shaped member at the other end;

(b) a partition located in the housing between the channels having a non-smooth surface on a side facing each channel;

(c) a ramped-shaped wall located in each channel on a side opposite the non-smooth partition side and sloped to widen each channel as the channel extends toward the other end;

(d) a pair of electrically conductive terminals embedded in the partition in a spaced apart relationship, each terminal having tangs extending into each channel at an acute angle inclined toward the other end of each channel and adapted to make electrical contact with one conductor of each drop wire in each channel as the drop wire is forced down on the tangs; and (e) polyisobutylene encapsulant located in each channel adapted to effect a moisture resistant splice; and (2) a pair of wedge shaped members, each member adapted for insertion into each channel at the other end thereof between the ramped surface and an inserted drop wire and having a non-smooth surface on the side facing the partition whereby each wedge shaped member may be forcibly inserted into each channel, after a drop wire has been fully inserted into each channel through the one end, to force the inserted drop wire down onto the tangs of the pair of electrical terminals to make an individual electrical contact between each conductor and a terminal, to lock the inserted drop wire between the non-smooth surface of the partition and the non-smooth surface of the forcibly inserted wedge, and to move the encapsulant located in each channel to form a moisture resistant seal about the inserted wedge and drop wire.

* * * * *